United States Patent [19]

Ito

[11] Patent Number: 4,988,226

[45] Date of Patent: Jan. 29, 1991

[54] PRINTER HAVING MAIN AND AUXILIARY PIN TRACTOR UNITS

[75] Inventor: Noritsugu Ito, Chita, Japan

[73] Assignee: Brother Kogyo Kabushiki Kaisha, Japan

[21] Appl. No.: 420,882

[22] Filed: Oct. 13, 1989

[30] Foreign Application Priority Data

Oct. 13, 1988 [JP] Japan ..... 63-257883
Oct. 21, 1988 [JP] Japan ..... 63-266775

[51] Int. Cl.[5] ..... B41J 11/50

[52] U.S. Cl. ..... 400/605; 400/616.1; 400/616.2; 226/74

[58] Field of Search ..... 400/616, 616.1, 616.2, 400/607, 608.4, 609, 611, 613.2, 605; 226/4, 36, 74–75, 108, 109, 110, 111

[56] References Cited

U.S. PATENT DOCUMENTS

| | | | |
|---|---|---|---|
| 3,049,276 | 8/1962 | Wilkins | 226/111 |
| 3,477,626 | 11/1969 | Hilpert | 226/109 |
| 4,743,130 | 5/1988 | Katagiri et al. | 226/74 |
| 4,771,921 | 9/1988 | Pearson et al. | 226/74 |

FOREIGN PATENT DOCUMENTS

| | | | |
|---|---|---|---|
| 663725 | 1/1965 | Belgium | 226/74 |
| 0118886 | 9/1980 | Japan | 400/616.2 |

OTHER PUBLICATIONS

"Feeding Apparatus for Continuous & Cut Forms", IBM Technical Disclosure Bulletin, vol. 6, No. 8, Jan. 1964, p. 91.

"Control Path for Continuous Form Feeding", IBM Techn. Disclosure Bulletin, vol. 1, No. 6, Apr. 1959, p. 3.

*Primary Examiner*—Eugene H. Eickholt

*Attorney, Agent, or Firm*—Oliff & Berridge

[57] ABSTRACT

A printer has a main pin tractor unit fixedly provided interiorly of a printer housing and an auxiliary pin tractor unit detachably mounted on the printer. The auxiliary pin tractor unit is mounted in a position immediately above the main pin tractor unit so that when the auxiliary pin tractor unit is detached from the printer, the main pin tractor unit is exposed to allow a continuous print sheet to be readily loaded on the main pin tractor unit. To selectively drive the main and the auxiliary pin tractor units with a single motor, a changeover mechanism is provided.

26 Claims, 9 Drawing Sheets

PRINTER HAVING MAIN AND AUXILIARY PIN TRACTOR UNITS

BACKGROUND OF THE INVENTION

The present invention relates to a printer having an auxiliary pin tractor unit in addition to a main pin tractor unit in which the auxiliary pin tractor unit is detachably mounted on the upper portion of the main pin tractor unit provided interiorly of a printer housing. The invention further relates to a printer having a changeover means for the selectively driving the two pin tractors with a single drive source.

A conventional printer includes a single pin tractor for supplying a continuous sheet and a sheet feed roller for supplying cut sheets. The printer further includes a transmission means for selectively transmitting rotations of a motor to the sheet feed roller and the pin tractor so that the latter two are driven with a single motor. Alternatively, a switching means is provided which, while constantly rotating the sheet feed roller, performs on/off switchings of the rotations of the pin tractor, wherein the rotations of the pin tractor are halted when the cut sheets are being supplied.

In such conventional printers, the cut sheets and the continuous sheet are available. However, it may be desirable to use another type of continuous sheet, different from the continuous sheet loaded on the pin tractor, depending upon the purpose of the printing. In such a case, the continuous sheet would need to be replaced with another one.

To this end, sheet replacement work has to be carried out in a manner such that: a sheet urging member urging the loaded continuous sheet is raised, the loaded continuous sheet is removed from the pin tractor to replace it with another continuous sheet by engaging perforations formed along the side marginal portions of the contiguous sheet with the pins of the pin tractor, and then the sheet urging member is laid down. When alternately using different kinds of continuous sheets, the sheet replacement work must be done very often.

Selective use of the two kinds of the continuous sheets may be possible if two pin tractors are installed in the printer. If this were done, the intricate sheet replacement work could be dispensed with. However, when it is desired to use still another kind of the continuous sheet which is different from those loaded in the two pin tractors, sheet replacement work must be done anyway. In addition, in order to perform the sheet replacement work, a working space needs to be provided near the place where the pin tractors are installed. Due to the structural limitations of the printer, however, a sufficient space cannot be reserved. Furthermore, if the two pin tractors are driven with a single motor. Either one of the two pin tractors must be selectively driven and both of the pin tractors must be halted at a time. A mechanism for changing over the driving between the sheet feed roller and a single pin tractor as used in the conventional printers is not available for the purpose of implementing the three-mode drive control.

The above and other problems remain unsolved and thus printers having two pin tractors have not yet been produced.

SUMMARY OF THE INVENTION

In view of the foregoing, it is an object of the present invention to provide a printer having an auxiliary pin tractor unit in addition to a main pin tractor unit, in which the auxiliary pin tractor unit is detachably mounted on the upper portion of the main pin tractor unit.

It is another object of this invention to provide a printer which is compact in size.

It is still another object of this invention to provide a printer in which a changeover mechanism is provided which, with the use of a single motor, performs three-mode drive control with respect to the two pin tractors.

In order to achieve the above and other objects, there is provided a printer comprising a housing, a print section including a print head and a platen disposed in confronting relation with each other for performing a print operation on a sheet of paper fed between the print head and the platen, a first pin tractor unit fixedly secured within the housing, the first pin tractor unit including a first pin tractor on which a first continuous print sheet is adapted to be loaded for supplying the first continuous print sheet to the print section, and a second pin tractor unit detachably mounted on the housing in a position above the first pin tractor unit sot hat the first pin tractor unit is exposed to allow the first continuous print sheet to be loaded on the first pin tractor when the second pin tractor unit is detached from the housing, the second pin tractor unit including a second pin tractor on which a second continuous print sheet is adapted to be loaded for supplying the second continuous print sheet to the print section.

The printer further comprises a single drive source, and changeover means coupled between the single drive source and the first and the second pin tractors for selectively driving the first and the second pin tractors with the single drive source. The printer includes a main gear rotated by the singe drive source, wherein the changeover means comprises a first driven gear operatively coupled to the first pin tractor, a second driven gear operatively coupled to the second pin tractor, a first transmitting member operatively coupled to the first driven gear, and a second transmitting member operatively coupled to the second driven gear, wherein the first and second transmitting members are selectively engageable with the main gear.

According to another aspect of the present invention, there is provided a printer comprising a print section including a print head and a platen disposed in confronting relation with each other for performing a print operation on a sheet of paper fed between the print head and the platen, a first pin tractor unit including a first pin tractor on which a first continuous print sheet is adapted to be loaded for supplying the first continuous print sheet to the print section, and a second pin tractor unit including a second pin tractor on which a second continuous print sheet is adapted to be loaded for supplying the second continuous print sheet to the print section, a single drive source, a main gear rotated by the single drive source, changeover means coupled between the single drive source and the first and the second pin tractor units for selectively driving the first and second pin tractor units with the single drive source, wherein the changeover means comprises a first driven gear operatively coupled to the first pin tractor unit, a second driven gear operatively coupled to the second pin tractor unit, a first transmitting member operatively coupled to the first driven gear, and a second transmitting member operatively coupled to the second driven gear, wherein in the first and second transmitting members are selectively engageable with the main gear.

In accordance with the present invention, two kinds of continuous sheets are selectively supplied to the print section by the provision of the two pin tractors. In addition, sheet replacement work with respect to the main pin tractor unit can readily be accomplished if the auxiliary pin tractor unit has been detached from the printer housing, since a large space is given above the main pin tractor unit.

In further accordance with the present invention, the changeover means is provided for selectively driving the two pin tractors with the single drive source. The drivings of the two pin tractors can also be halted with the changeover means.

The above and other objects, features and advantages of the present invention will become more apparent from the following description when taken in conjunction with the accompanying drawings, in which a preferred embodiment of the present invention is shown by way of illustrative example.

BRIEF DESCRIPTION OF THE DRAWINGS

FIG. 7 is a partially enlarged view showing the auxiliary pin tractor unit mounted on the printer;

FIG. 8 is a plan view showing a changeover means;

FIG. 9 is a perspective view showing an outer appearance of a cam employed in the changeover means shown in FIG. 8;

FIGS. 10A through 10C are plan views of a the changeover means for description of the operation thereof;

FIG. 11A through 11C are upper exploded views of the changeover means for description of the operation thereof;

FIG. 12 is a block diagram showing a control unit incorporated in the printer;

FIG. 13 is a flow chart for description of the operation of the control unit; and FIG. 14 is a subroutine of an operation A contained in the flowchart of FIG. 13.

DETAILED DESCRIPTION OF THE PREFERRED EMBODIMENTS

In the following description, the expression "front", "rear", "above" and "below" are used to define the various parts when the printer is disposed in an orientation in which it is intended to be used.

Figure 1:
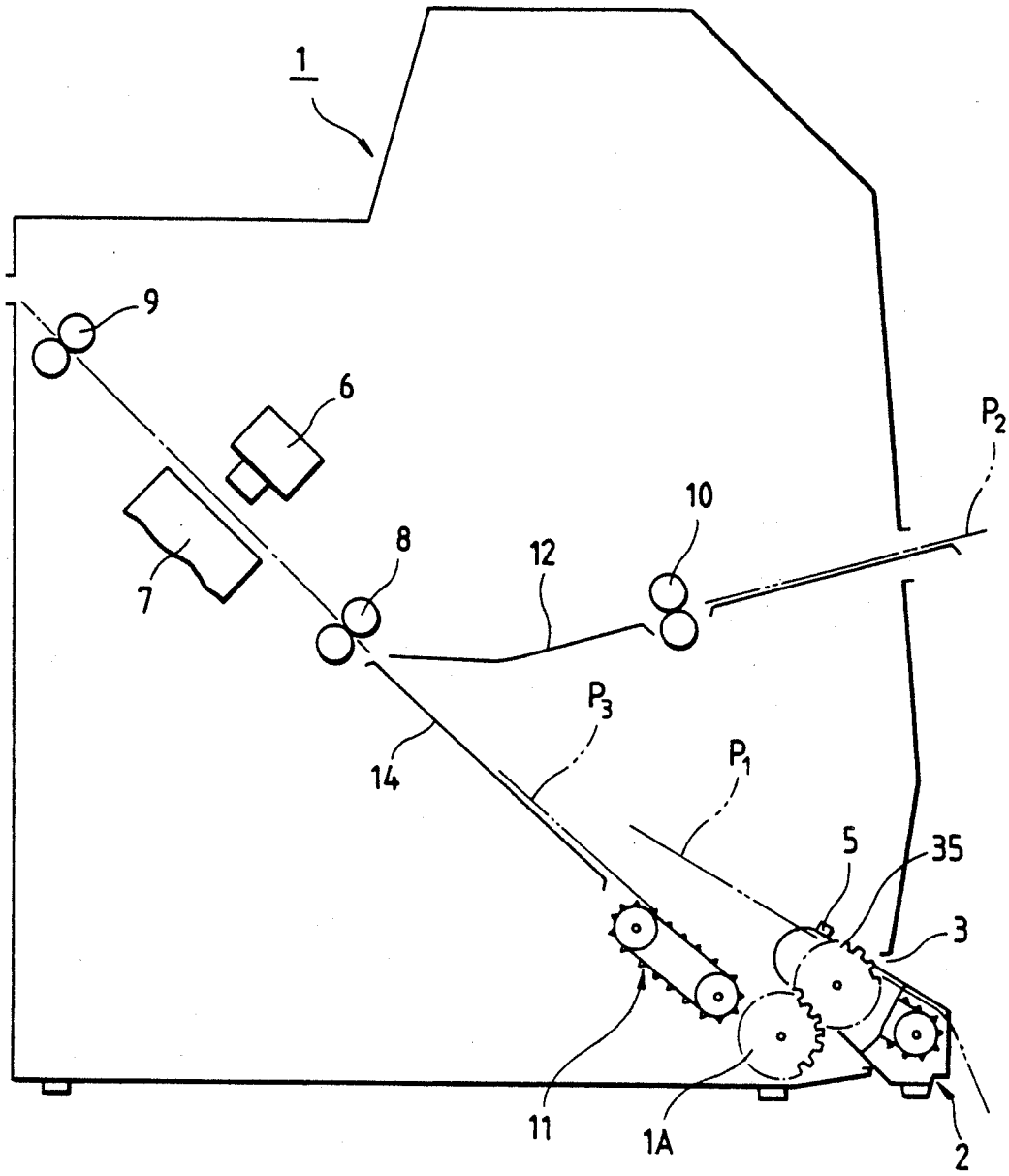
FIG. 1 is a vertical cross-sectional view fragmentarily showing an inner arrangement of a printer according to the present invention.

FIG. 1 is a vertical cross-section fragmentarily illustrating an inner arrangement of the printer, in which the printer is disposed so that the front portion thereof is on the right side in the figure. In the front lower portion of the printer 1, an opening is formed for allowing an auxiliary pin tractor unit 2 to be inserted thereinto. In the printer chassis 15, 15 (see FIG. 6), mount sections 16, 16 are provided for detachably mounting the pin tractor unit 2. On each mount section 16, a rail member 17 and a locking pin 4 are fixedly secured, in which the rail member 17 is provided with a groove 17*a* extending to the opening portion 3. Each mount section 16 includes a sensor 5 for sensing the mounting of the auxiliary pin tractor unit 2.

Referring back to FIG. 1, there are provided in the printer 1 a print section including a print head 6 and a platen 7, feed roller pairs 8, 9 respectively disposed frontwardly and rearwardly of the print section, a pair of sheet feed rollers 10 for feeding cut sheets P2 fed through a manual insertion tray into the print section, a main pin tractor unit 11 and an auxiliary pin tractor unit 2. The print head 6 and the platen 7 are disposed in confronting relation with each other for performing a print operation on a sheet of paper fed between the print head 6 and the platen. The main pin tractor unit 11 is fixedly secured within the printer housing. The main pin tractor unit 11 includes a main pin tractor on which a continuous print sheet P3 is adapted to be loaded for supplying the sheet to the print unit. The auxiliary pin tractor unit 2 is detachably mounted on the printer 1 or its housing in a position above the main pin tractor unit 11. The main pin tractor unit 11 is exposed to allow the continuous print sheet P3 to be loaded on the main pin tractor when the auxiliary pin tractor unit 2 is detached from the printer 1 or its housing. The auxiliary pin tractor unit 2 includes an auxiliary pin tractor on which another kind of continuous print sheet P1 is adapted to be loaded for supplying it to the print section. The main and the auxiliary pin tractors are selectively driven by a single motor through a changeover means (to be described later) coupled between the motor and the main and auxiliary pin tractors. The changeover means includes a main gear 1A. The motor further drives the feed roller pairs 8, 9, 10.

The printer 1 further includes sheet guides 12, 14. The sheet guide 12 is disposed downstream of a manual insertion tray from which cut sheets P2 are manually inserted. The sheet guide 14 is disposed downstream of the main and auxiliary pin tractor units 11, 2 for guiding the continuous print sheets P3, P1 fed by the main and the auxiliary pin tractor units 11, 2 toward the print section.

Figure 2:
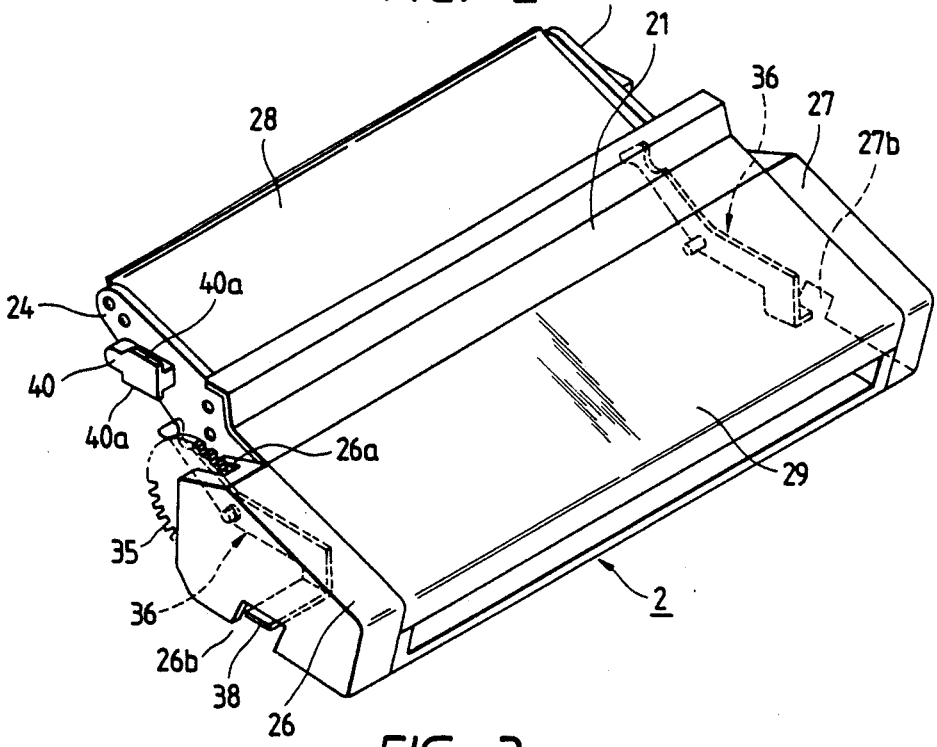
FIG. 2 is a perspective view showing an outer appearance of an auxiliary pin tractor unit.
Figure 3:
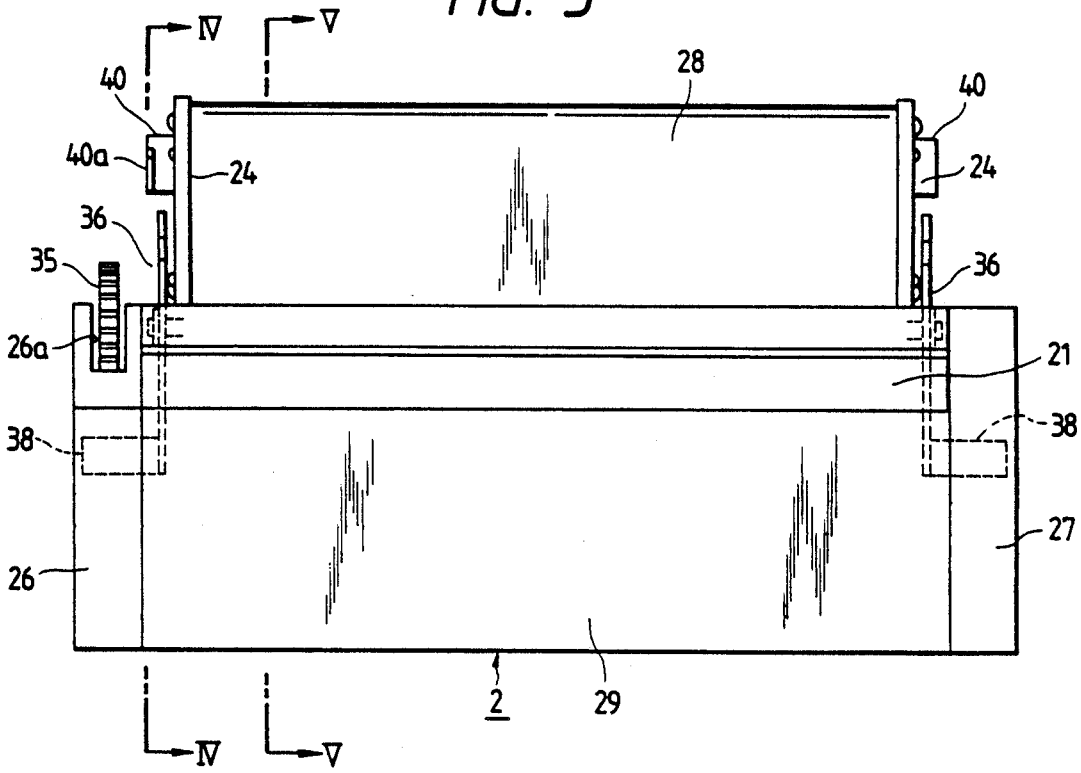
FIG. 3 is a plan view showing the auxiliary pin tractor unit shown in FIG. 2.
Figure 4:
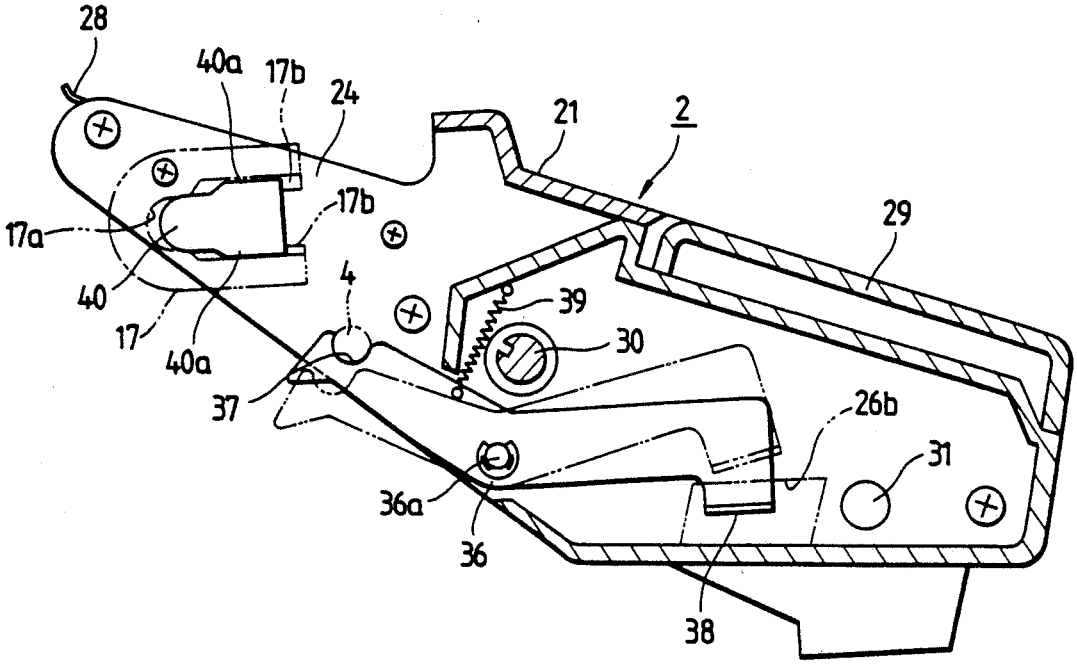
FIG. 4 is a cross-sectional view of the auxiliary pin tractor unit shown in FIG. 3 cut along a line IV—IV.
Figure 6:
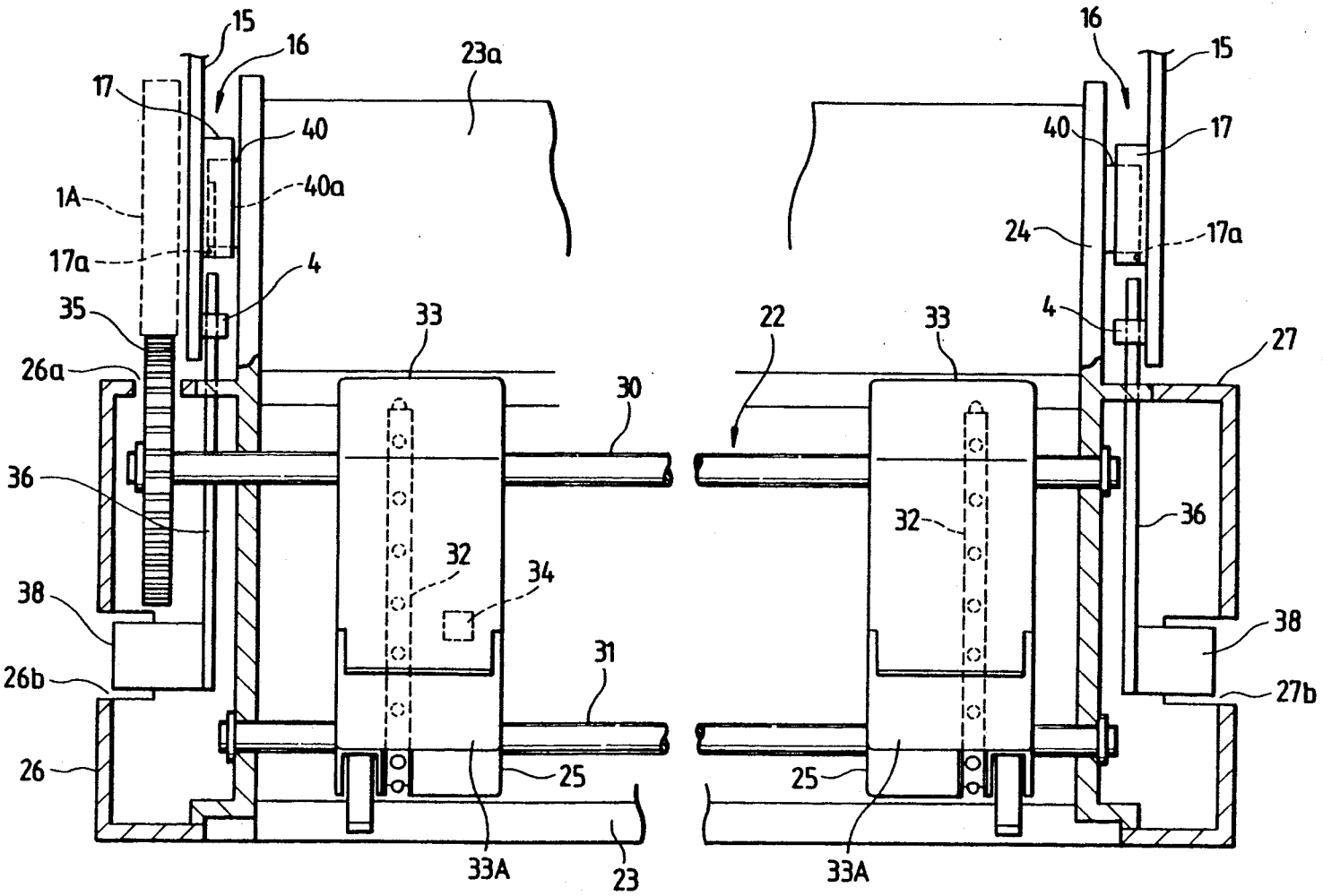
FIG. 6 is a plan view showing the auxiliary pin tractor unit.

FIG. 2 is a perspective view showing an external appearance of the pin tractor unit 2, FIG. 3 is a plan view thereof, FIG. 4 is a cross-sectional view cut along the line IV—IV, and FIG. 6 is a plan view showing the arrangement of the auxiliary pin tractor unit 2. The pin tractor unit 2 has a casing which includes a chassis 23, a pair of side frames 24,24 each fixedly secured rightwardly and leftwardly of the chassis 23, and an upper cover 21 bridging over the central portions of the side frames 24, 24. The pin tractor 22 is included in this casing.

The side frames 24, 24 are tapered down at the rear halves thereof, and side covers 26, 27 are attached to the front halves of the side frames 24, 24. The rear portion of the chassis 23 (see FIG. 6) extends in a direction in which the print sheet is entrained by the auxiliary pin tractor for serving as a guide surface 23*a* of the continuous sheet. A sheet guide plate 28 is aligned in spaced apart relation with the guide surface 23*a* and is fixedly secured to the side frames 24, 24 to bridge thereof. A lid 29 is openably provided frontwardly of the upper cover 21 so as to bridge over the side frames 24, 24. The auxiliary pin tractor 22 is covered by the lid 29.

As shown in FIG. 6, the pin tractor 22 includes a rotation shaft 30 and a guide shaft 31. The rotation shaft 30 has two ends rotatably supported by the side frames 24. The guide shaft 31 has two ends supported in the side frames 24. The rotation shaft 30 and the guide shaft 31 are arranged in parallel relation with each other. A pair of slide frames 25, 25 are axially slidably supported on shafts 30, 31. A wheel (not shown) is rotatably supported by the slide frames 25, 25 and rotated by the rotation shaft 30. A pair of belts 32, 32 are mounted on the wheel and each belt has a surface in which a predetermined number of pins are embedded at predetermined intervals. The predetermined number of pins are engageable with perforations formed on the side marginal portions of the continuous sheet so that the continuous sheet is entrained in accordance with the rotations of the wheel. A pair of sheet locking members 33, 33 are provided above the belts for paper locking. In the right-hand slide frame 25, a sensor 34 is provided for detecting the presence of the continuous sheet mounted on the belt 32. A driven gear 35 is attached to one end of the rotation shaft 30. The driven gear 35 is disposed within a space defined by the side frame 24 and the lefthand side cover 26 and partially protrudes rearwardly out of the opening 26*a* of the side cover 26 so as to meshingly engage the main gear 1A provided in the printer 1.

In the spaces defined by the side covers 26, 27, swing arms 36, 36 are swingably provided on the shaft 36*a*, the swing arm extending outwardly through the side frame 24 so as to be swingable with respect to the center portion. As best shown in FIG. 4, each swing arm 36 has a convex shape hook 37 at its rear end, which is adapted to engage the pin 4 provided in the printer chassis 15. The front portions of the arms 36 are formed with operation pieces 38 which protrudes outwardly through the openings 26*b*, 27*b* at the bottom of the side covers 26, 27. The operation pieces 38 are normally biased by a spring 39 in the direction in which the hook 37 engages the pin 4.

Rib-like protrusions 40, 40 to be inserted into the groove 17*a* of the rail member 17 are formed on the rear side surfaces of the side frames 24, 24. A flange-like protrusion 40*a* is formed on the side edge of the rib-like protrusions 40, 40. In the opposing rail members 17, locking grooves 17*b* are formed along the inner surface of the grove 17*a*. When the rib-like protrusion 40 is inserted into the groove 17*a*, the flange-like protrusion 40*a* is engaged with the groove 17*b*, whereupon the vertical and horizontal positions of the pin tractor unit 2 are determined with respect to the printer 1. The engagement of the arm 36 with the pin 4 prevents the pin tractor unit 2 from being detached from the printer and positions the pin tractor unit 2 in the frontward or rearward direction.

Figure 5:
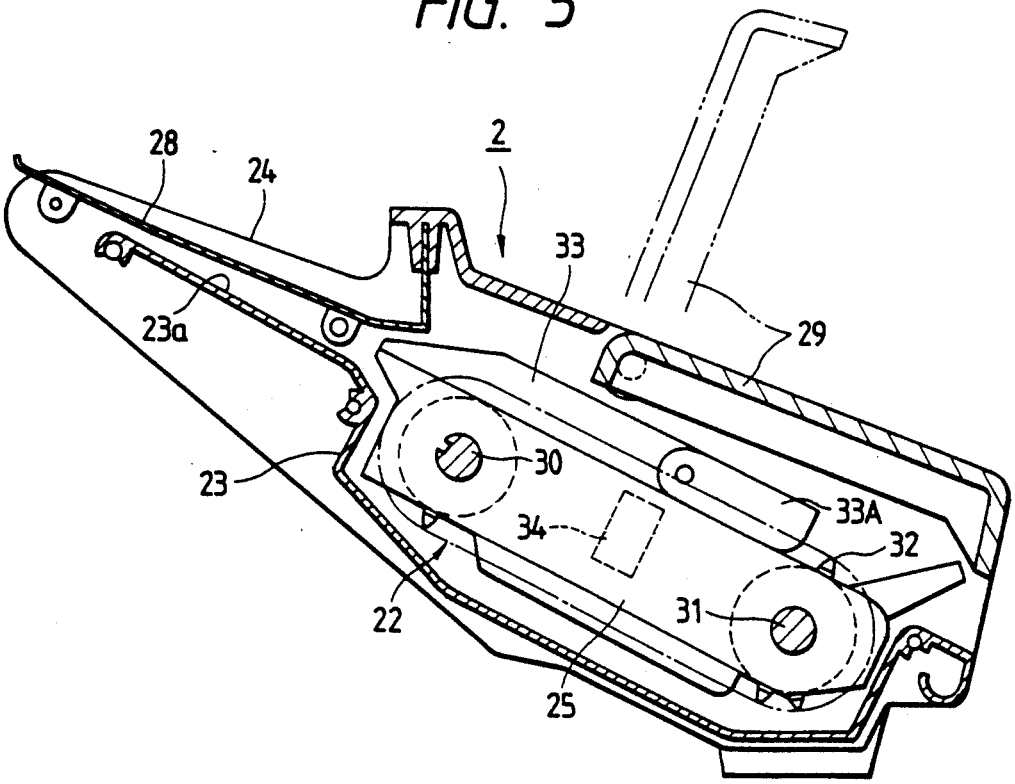
FIG. 5 is a cross-sectional view of the auxiliary pin tractor unit shown in FIG. 3 cut along a line V—V.

Referring to FIG. 5, to load the continuous sheet P1 on the pin tractor unit 2, while maintaining the lid 29 in opened state and releasing a swing piece 33*a* of the sheet locking member, the perforations formed in the side margins of the continuous sheet engage with the pins embedded in the belt 32. Thereafter the swing piece 33*a* is closed or laid down and the lid 29 is closed. When the loaded continuous sheet P1 is replaced with another continuous sheet, the continuous sheet P1 is removed pursuant to the above steps performed in reversed order, and thereafter another continuous sheet may be loaded. According to the present invention, since the auxiliary pin tractor unit 2 is disposed immediately above the main pin tractor 11, the replacement work of the continuous sheet P3 in the main pin tractor 11 can readily be performed if the auxiliary pin tractor nit 2 is first removed from the printer 1. After removal of the pin tractor unit 2, a large space is available at the upper portion of the pin tractor 11.

FIG. 7 shows the auxiliary pin tractor unit 2 mounted on the printer 1. The rear tapered portion of the pin tractor unit 2 is inserted into the opening 3 of the printer 1. In the fully inserted state of the pin tractor unit 2, the rib-like protrusion 40 engages the rial member 17 and the swing arm 36 engages the locking pin 4. Under this condition, a sheet path defined by the chassis 23 of the pin tractor unit 2 and the guide plate 28 is formed close to the guide plate 14. Accordingly, the continuous sheet P1 fed by the auxiliary pin tractor unit 2 passes through the sheet path defined by the chassis 23 and the guide plate 28 and is then delivered to the guide plate 14.

Next, a description will be made regarding the mounting and removing procedures of the auxiliary pin tractor unit 2.

When mounting the auxiliary pin tractor unit 2 on the printer 1, the pin tractor unit 2 is inserted into the opening 3 formed on the housing 1 while the rear tapered portion of the pin tractor unit 2 is directed obliquely downwardly. The rear tapered portion thereof is gradually lifted as it is inserted into opening 3. Upon completion of the after insertion of the pin tractor unit 2, the rib-like protrusion 40 will be supported by the rail member 17. The tip end of the swing arm 36 is brought into abutment with the locking pin 4, whereat the swing arm 36 is momentarily rotated in counter-clockwise direction against the biasing force of the spring 39. When the swing arm 36 is further moved into the deeper level, the swing arm 36 is swung in the clockwise direction due to the biasing force of the spring 39 so that the hook 37 is brought into engagement with the locking pin 4. This completes the mounting of the pin tractor unit 2, at which point the driven gear 35 is brought into meshing engagement with the main gear 1A.

When the pin tractor unit 2 is removed from the printer 1, the operation piece 38 of the swing arm 36 is manually lifted, thereby swinging the swing arm 36 in counter-clockwise direction through a certain angle so that the engagement of the hook 37 with the locking pin 3 is released. Then, the pin tractor unit 2 is lifted and pulled obliquely downwardly while lifting the pin tractor unit 2.

A sensor 5 is provided in the printer, which senses that the auxiliary pin tractor unit 2 is mounted on the printer housing 1. In response to the output from the sensor 5, a display on an operation panel indicates that the pin tractor unit 2 has been mounted on the printer 1. When the continuous sheet P1 which (is entrained by the auxiliary pin tractor unit 2) is intended to be used, a sheet selection key provided on the operation panel is depressed to thereby specify pin tractor unit 2. Then, a control unit ensures that the rotation of the motor is exclusively transmitted to the auxiliary pin tractor unit 2 upon reception of both a mount indicative signal outputted from the sensor 5 and a sheet presence signal outputted from the sensor 34. Before the auxiliary pin tractor unit 2 receives the power transmission, if the continuous sheet P3 feed by the main pin tractor 11 has been fed into the print section, this condition may be sensed and the continuous sheet P3 may be retracted to a predetermined position.

As shown in FIG. 8, the changeover means includes a cam 42 rotated by the changeover motor 41 and a pair of transmitting members 44, 45 which are displaced in their axial directions corresponding to the configuration of the abutting cam surface 43 of the cam 42. The cam 42 is rotatably supported on a shaft 50 formed on the printer chassis. As shown in FIG. 9, the cam 42 has an axially protruding semicircular cam surface 43. The cam 42 also has an outer periphery on which gears are partly provided so as to meshingly engage the output gears 41A of the changeover motor 41. The cam surface 43 is in part provided with a flat protruding portion 43A and tapered portions 43B, 43C at both sides of the flat protruding portion 43A.

The transmitting member 44 includes a lifter 46 having one end rotatably supported on a shaft 51, and an idle gear 48 rotatably supported on another end of the lifter 46. Likewise, the transmitting member 45 includes a lifter 47 having one end rotatably supported on a shaft 52, and an idle gear 49 rotatably supported on another end of the lifter 46. The driven gear 11A of the main pin tractor 11 is disposed adjacent the first idle gear 48. In a similar fashion, the driven gear 35 of the auxiliary pin tractor unit 2 is disposed adjacent the second idle gear 49. Between the driven gears 11A and 35, the main gear 1A is disposed and is driven by a drive motor 54A via a belt 53.

A limit switch 55 is provided in association with the cam 42 for detecting a rotational angle of the cam 42. The limit switch 55 performs on/off switchings when the limit switch 55 is in abutment with an upstanding pin 42A. The operations of the transmitting members 44,45 are controlled by the rotations of the cam 42 which rotates a predetermined angle from the position where the limit switch 55 is turned on by the contact with the pin 42A.

As shown in FIG. 12, a printer 1 includes a central processing unit (CPU) 56 which controls various operations of the printer 1. To the CPU 56, a read-only memory (ROM) 57 and a random access memory (RAM) 58 are connected. The ROM 57 stores programs executed by the CPU 56 and print patterns. The RAM 58 temporarily stores spring data supplied from a host computer (not shown). To the CPU 56, connected through an input/output interface 59 are panel switch 60, limiter switch 55, the changeover motor 41, the drive motor 54A, the sensor 5 and a page-end (PE) sensor 32. The panel switch 60 includes a plurality of switches used by the operator for specifying the operations to be performed by the printer 1, and for selecting the spring sheet to be supplied from either the manual insertion tray, the main pin tractor 11, or the auxiliary pin tractor 2.

Next, referring to FIGS. 10 through 14, a description will be made regarding the operations when two pin tractors are selectively used.

When the panel switch 60 is manipulated, the printer 1 is placed in a sheet supply selection mode, whereupon the CPU 56 executes the steps in the flowchart of FIG. 10.

In step S1, the CPU 56 checks whether or not the main pin tractor 11 is selected by the manipulation of the panel switch 60. If yes, the CPU 56 executes in step S4 the operation A indicated in FIG. 13. When the CPU 56 determines that the main pin tractor 11 has not been selected in step S1, the program proceeds to step S2 where the CPU 56 checks whether or not the auxiliary pin tractor 2 has been selected. If yes, the CPU 56 executes the processing in step S3. In response to the output signal from the sensor 5, the CPU 56 checks whether or not the auxiliary pin tractor 2 has been mounted on the printer 1. If the sensor output indicates that the auxiliary pin tractor 2 has been mounted on the printer 1, the CPU 56 executes in step S5 the operation A. When, on the other hand, the sensor output indicates that the auxiliary pin tractor 2 has not been mounted thereon, the CPU 56 executes in step S6 the error processing and alerts the operator to the fact that the selected auxiliary pin tractor 2 has not been mounted on the printer 1. In step S2, if the auxiliary pin tractor 2 has not been selected, the CPU 56 executes operation A in step S7.

In steps S4, S5 and S7, the CPU 56 executes operation A in accordance with the flowchart indicated in FIG. 12. In step S11, the CPU 56 checks whether or not the print sheet has been supplied from the manual insertion tray immediately before the setting of the sheet feed selection mode. If yes, the CPU 56 executes the processing in step S12. If the print sheet has been supplied from either the main pin tractor 11 or the auxiliary pin tractor 2, the CPU 56 executes the processing instep S13.

In steps S12 and S13, the CPU 56 receives the output signal from the sensor for detecting the presence of the print sheet within the print section, and in response thereto the CPU 56 checks whether the print sheet is present within the print section. In step S12, if the decision made by the CPU 56 indicates that the print sheet is present within the print section, the CPU 56 operates to feed the print sheet out of the print section in step S14 upon driving the feedout rollers 8, 9 to feed the sheet in the feedout direction. Decision made in step S13 is that the print sheet is present within the print section, the CPU 56 operates to drive the feedout rollers 8, 9 and the main and auxiliary pin tractors 11, 2 in the direction opposite to the feedout direction, thereby retracting the print sheet to a position where the leading edge of the print sheet is detectable by the PE sensor 32. After executing steps S14 and S15, the CPU 56 terminates operation A. When the decisions made in steps S12 and S13 indicates that there is no print sheet in the print section, the CPU 56 terminates operation A.

After the CPU 5 has executed the operation A in step S4, it executes the changeover operation I instep S8. Since the main pin tractor 11 has been selected in step S1, the CPU 56 operates to rotate the cam 42 in the prescribed direction by a predetermined angle to thereby position the protrusion piece of the first lifter 46 on the flat surface of the cam 42 and also to positron the protrusion piece of the second lifter 47 on the raised portion 43A of the cam surface as in the state shown in FIG. 10A. Then, as shown in FIG. 11A, the first idle gear 48 is displaced, together with the first lifter 46, toward the side close to the printer chassis, whereupon the first idle gear 48 is brought into meshing engagement with the driven gear 11A. On the other hand, the second idle gear 49 may be displaced together with the second lifter 47 toward the side away from the printer chassis, with the result that the second idle gear 49 is disengaged from the main gear 1A and the driven gear 35 of the auxiliary pin tractor 2. With this changeover operation, the power of the main gear 1A is only transmitted to the driven gear 11A of the main pin tractor 11.

After the CPU 56 executes the operation A in step S5, it executes the changeover operation II in step S9. Since in step S2 it has been detected that the auxiliary pin tractor 2 has been mounted on the printer 1, the CPU 56 implements the operation reverse to the changeover operation I upon driving the changeover motor 41. Specifically, as shown in FIG. 10B, the protrusion piece of the first lifter 46 is positioned on the raised surface 43A of the cam surface 43 and the protrusion piece of the second lifter 47 is positioned on the flat surface of the cam 42. Then, as shown in FIG. 11B, the second idle gear 49 is caused to be displaced together with the second lifter 47 toward the side close to the printer chassis, whereupon the second idle gear 49 is brought into engagement with both the main gear 1A and the driven gear 35 of the auxiliary pin tractor 2. On the other hand, the first idle gear 48 is caused to be displaced together with the first lifter 46 toward the side remote from the printer chassis, with the result that the first idle gear 48 is disengaged from both the main gear 1A and the driven gear 11A of the main pin tractor 11. By this changeover operation II, the power of the drive gear 52 is only transmitted to the driven gear 35 of the auxiliary pin tractor 2.

After the CPU 56 executes the operation A in step S7, it executes the changeover operation III in step S10. Since neither the main pin tractor 11 nor the auxiliary pin tractor 2 has been selected in step S2, the CPU recognizes that the manual insertion tray has been selected. Then, the CPU 56 operates to drive the changeover motor 41, and to position both the protrusion pieces of the first and the second lifters 46, 47 on the raised portion 43A. As shown in FIG. 11C, the first and the second idle gears 48, 49 together with the first and second lifters are caused to be displaced toward the side remote from the printer chassis, so that the idle gears 48, 49 of the main and the auxiliary pin tractors 11, 2 are disengaged from the irrespective driven gears 11A, 33. Therefore, even if the main gear 1A were driven, power is not transmitted to the two pin tractors.

After the CPU 56 implements the respective changeover operations in steps S8, S9 and S10, the CPU 56 terminates the sheet supply selection mode.

When the main pin tractor is selected with the operations described above, the rotations of the drive motor 54A are transmitted only to the main pin tractor 11. When the auxiliary pin tractor 2 is selected, the rotations of the drive motor 54A are transmitted only to the auxiliary pin tractor 2. When none of the pin tractors ar selected, the rotations of the drive motor 54A are not transmitted to the two pin tractors, instead the print sheet is fed from the manual insertion tray.

While the present invention has been described with reference to a specific embodiment, it can be appreciated by those skilled in the art that a variety of changes and modification may be made without departing from the scope and spirit of the invention. For example, in the above embodiment, the auxiliary pin tractor is encased within a casing and used as a unit which is detachably mounted on the printer. However, not only the main pin tractor but also the auxiliary pin tractor may be fixedly installed in the printer.

What is claimed is:

1. A printer comprising:

a housing;

a print section including a print head and a platen disposed in confronting relation with each other for performing a print operation on a sheet of paper fed between the print head and the platen;

a first pin tractor unit fixedly secured within the housing, the first pin tractor unit including a first pin tractor on which a first continuous print sheet is adapted to be loaded for supplying said first continuous print sheet to said print section; and a second pin tractor unit detachably mounted on said housing in a position above said first pin tractor unit so that said first pin tractor unit is exposed to allow the first continuous print sheet to be loaded on said first pin tractor when said second pin tractor unit is detached from said housing, said second pin tractor unit including a second pin tractor on which a second continuous print sheet is adapted to be loaded for supplying said second continuous print sheet to said print section.

2. A printer according to claim 1, further comprising:

a single drive source; and changeover means coupled between said single drive source and said first and said second pin tractors for selectively driving said first and said second pin tractors with said single drive source.

3. A printer according to claim 2, further comprising a main gear rotated by said single drive source, wherein said changeover means comprises a first driven gear operatively coupled to said first pin tractor, a second driven gear operatively coupled to said second pin tractor, a first transmitting member operatively coupled to said first driven gear, and a second transmitting member operatively coupled to said second driven gear, wherein said first and second transmitting members are selectively engageable with said main gear.

4. A printer according to claim 1, further comprising a casing for encasing said second pin tractor unit.

5. A printer according to claim 4, wherein said casing comprises a bottom frame having two side edges, a pair of side frames fixedly secured to the two side edges of said bottom frame, and an upper frame bridging between said pair of side frames.

6. A printer according to claim 5, further comprising a lid openably provided to said casing, wherein when said lid is being in opened state, said second continuous print sheet is allowed to be loaded on said second pin tractor.

7. A printer according to claim 5, wherein said second pin tractor unit comprises a rotation shaft (30) having two ends rotatably supported by said pair of side frames (24, 24), a guide shaft (31) having two ends supported by said pair of side frames and arranged in parallel relation with said rotation shaft (30), a pair of slide frames (25, 25) axially slidably supported on both said rotation shaft (30) and said guide shaft (31), a wheel rotatably supported by said pair of slide frames and rotated by said rotation shaft (30), and a pair of belts (32, 32) mounted on said wheel and each belt having a surface in which a predetermined number of pins are embedded at a predetermined interval, the predetermined number of pins being engageable with perforations formed on said second continuous print sheet so that said second continuous print sheet is entrained in accordance with rotations of said wheel.

8. A printer according to claim 7, further comprising sheet locking means for locking said second continuous print sheet loaded on said second pin tractor.

9. A printer according to claim 7, further comprising a main gear, a drive source for rotating said main gear, and a driven gear coupled to one end of said rotation shaft, said driven gear being meshingly engageable with said main gear.

10. A printer according to claim 5, wherein said bottom frame extends in a direction in which said second continuous print sheet is entrained by said second pin tractor for serving as a guide surface of said second continuous print sheet.

11. A printer according to claim 9, further comprising a first sensor for sensing the mounting of said second pin tractor unit on said housing, said first sensor outputting a signal indicative of the mounting of said second pin tractor unit on said housing.

12. A printer according to claim 11, further comprising a second sensor for sensing the engagement of said pins with the perforations, said second sensor outputting a signal indicative of the engagement of said pins with the perforations.

13. A printer according to claim 12, further comprising a positioning mechanism for positioning said second pin tractor unit mounted on said housing.

14. A printer according to claim 12, further comprising retaining means (4, 36) for retaining said second pin tractor unit mounted on said housing in a position determined by said positioning mechanism.

15. A printer according to claim 13, wherein said driven gear is brought into engagement with said main gear when said second pin tractor unit is positioned by said positioning means.

16. A printer according to claim 13, further comprising display means responsive to the output of said second sensor for displaying a condition in which said second pin tractor unit is available.

17. A printer according to claim 16, further comprising an operation panel having a sheet selection key for selecting a sheet to be used, wherein when said second continuous print sheet is selected by said sheet selection key, said main gear is brought into meshing engagement with said driven gear provided that the signals have been outputted from both said first and second sensors.

18. A printer according to claim 10, wherein said casing further comprises a sheet guide plate aligned in spaced apart relation with said guide surface.

19. A printer according to claim 18, further comprising a first sheet guide (14) housed in said housing for guiding said first and second continuous print sheets toward said print section, and wherein said first pin tractor unit is disposed downstream of said guide plate (14), and when said second pin tractor unit is mounted on said housing, said guide surface (23*a*) and said sheet guide plate (28) are disposed above said first pin tractor unit and close to said first sheet guide.

20. A printer according to claim 5, further comprising a positioning mechanism for positioning said second pin tractor unit mounted on said housing.

21. A printer according to claim 20, wherein said positioning mechanism comprises a pair of rail members (17) provided within said housing, and a pair of rib-like protrusions (40) provided in said side frames, said pair of rib-like protrusions being slidably engageable with said pair of rail members, respectively.

22. A printer according to claim 21, wherein said housing is formed with an opening allowing to receive said second pin tractor unit, and wherein each of said pair of rail members (17) is formed with a groove (7*a*) for receiving each of said pair of rib-like protrusions (40).

23. A printer according to claim 22, wherein one of said pair of rib-like protrusions (40) has a side edge in which a flange-like protrusion is formed, one of said pair of rail members associated with said one of said pair of rib-like protrusions is formed with a locking groove in said groove, and wherein when said one of said pair of rib-like protrusions is engaged with said groove, said flange-like protrusions (40*a*) is adapted to engage said locking groove (17*b*).

24. A printer comprising:

a print section including a print head and a platen disposed in confronting relation with each other for performing a print operation on a sheet of paper fed between the print head and the platen;

a first pin tractor unit including a first pin tractor on which a first continuous print sheet is adapted to be loaded for supplying said first continuous print sheet to said print section; and a second pin tractor unit including a second pin tractor on which a second continuous print sheet is adapted to be loaded for supplying said second continuous print sheet to said print section;

a single drive source;

a main gear rotated by said single drive source;

changeover means coupled between said single drive source and said first and said second pin tractor units for selectively driving said first and said second pin tractor units with said single drive source, wherein said changeover means comprises a first driven gear operatively coupled to said first pin tractor unit, a second driven gear operatively coupled to said second pin tractor unit, a first transmitting member operatively coupled to said first driven gear, and a second transmitting member operatively coupled to said second driven gear, wherein said first and second transmitting members are selectively engageable with said main gear.

25. A printer according to claim 24, wherein said changeover means includes a cam rotated by said single drive source, and wherein said first transmitting member includes a first gear meshingly engageable with both said main gear and said first driven gear, said first transmitting member being axially movably provided, and said second transmitting member includes a second gear meshingly engageable with said main gear and said second driven gear, said second transmitting member being axially movably provided, said first and second gears being axially moved according to the rotation of said cam.

26. A printer according to claim 25, further comprising a second sheet guide for guiding a third print sheet, and wherein said cam causes said first gear to disengage from both said main gear and said first driven gear, and said second gear to disengage from both said main gear and said second driven gear.

* * * * *